US009486095B2

(12) United States Patent
Flora et al.

(10) Patent No.: US 9,486,095 B2
(45) Date of Patent: Nov. 8, 2016

(54) SHELL WITH ARM PORTS

(71) Applicant: American Recreation Products, LLC., Boulder, CO (US)

(72) Inventors: Martin Flora, Portland, OR (US); Casey Sumnicht, Longmont, CO (US); Michael Glavin, Spokane, WA (US)

(73) Assignee: Exxel Outdoors, LLC, Boulder, CO (US)

( * ) Notice: Subject to any disclaimer, the term of this patent is extended or adjusted under 35 U.S.C. 154(b) by 0 days.

(21) Appl. No.: 14/256,310

(22) Filed: Apr. 18, 2014

(65) Prior Publication Data

US 2014/0352061 A1 Dec. 4, 2014

Related U.S. Application Data

(60) Provisional application No. 61/828,348, filed on May 29, 2013.

(51) Int. Cl.
*A47G 9/08* (2006.01)

(52) U.S. Cl.
CPC ..... *A47G 9/086* (2013.01)

(58) Field of Classification Search
CPC ..... A47G 9/08; A47G 9/083; A47G 9/086; A41B 13/06; A41B 13/065
See application file for complete search history.

(56) References Cited

U.S. PATENT DOCUMENTS 1,701,929 A * 2/1929 Mettam ..... 2/83
1,929,263 A * 10/1933 Sork ..... 2/69.5
2,469,700 A * 5/1949 Petroceill ..... 2/69.5
2,511,242 A * 6/1950 Brown ..... 2/279
2,803,824 A 8/1957 Parish
3,258,781 A * 7/1966 Klein ..... 2/88
3,381,306 A * 5/1968 Innes ..... 2/69
3,837,006 A * 9/1974 Laseman ..... 2/89
3,878,574 A * 4/1975 Erickson ..... 5/413 R
3,924,273 A * 12/1975 Donovan ..... 2/69.5
4,103,377 A * 8/1978 Mayer et al. ..... 2/69.5
4,507,805 A 4/1985 Calutoiu
5,101,513 A * 4/1992 Bowers ..... 2/84

(Continued)

FOREIGN PATENT DOCUMENTS

BE 664333 A 9/1965
BE 903161 A2 12/1985

(Continued)

OTHER PUBLICATIONS

International Search Report and Written Opinion for PCT/US2014/034630 dated Aug. 27, 2014; 9 pages.

*Primary Examiner* — David E Sosnowski
*Assistant Examiner* — Eric Kurilla
(74) *Attorney, Agent, or Firm* — Stinson Leonard Street LLP

(57) ABSTRACT

A sleeping bag has an elongate shell defining a longitudinal axis and an inner volume sized and shaped to receive a user therein. The shell has a pair of fastener-less arm ports. Each of the arm ports is selectively moveable from a closed port position to an opened port position. Each of the ports has an inner panel and an outer panel. The inner panel is positioned in overlapping face-to-face engagement with the outer panel in the closed port position such that the inner and outer panels are generally in the same plane as the overlying portion. The outer panel is spaced from the inner panel in the opened port position to define a passage for allowing the user to extend their arm through the respective port.

27 Claims, 23 Drawing Sheets

(56) References Cited

U.S. PATENT DOCUMENTS

| | | | | |
|---|---|---|---|---|
| 6,263,510 | B1 | 7/2001 | Bay et al. | |
| 6,272,683 | B1 * | 8/2001 | Symms et al. | 2/69.5 |
| 6,334,221 | B1 * | 1/2002 | Hope | 2/69.5 |
| 6,760,926 | B1 * | 7/2004 | Miller | 2/250 |
| 7,263,730 | B2 * | 9/2007 | Crawford | 5/413 R |
| 7,802,844 | B1 * | 9/2010 | Vencill | 297/184.14 |
| D641,136 | S * | 7/2011 | Abrams et al. | D2/719 |
| D693,987 | S * | 11/2013 | Wagner et al. | D2/719 |
| 8,578,525 | B1 * | 11/2013 | Seth | 5/413 R |
| 2004/0128731 | A1 * | 7/2004 | Marty et al. | 2/69 |
| 2005/0034206 | A1 * | 2/2005 | Marty et al. | 2/69 |
| 2005/0217004 | A1 * | 10/2005 | Haberfeld | 2/69.5 |
| 2007/0061965 | A1 * | 3/2007 | Crawford | 5/413 R |
| 2008/0028518 | A1 * | 2/2008 | Miotke et al. | 5/482 |
| 2008/0120774 | A1 * | 5/2008 | Hite | 5/494 |
| 2010/0122393 | A1 | 5/2010 | Light et al. | |
| 2010/0212060 | A1 * | 8/2010 | Whitcomb | 2/75 |
| 2011/0035857 | A1 * | 2/2011 | Quintanilla | 2/52 |
| 2011/0067163 | A1 * | 3/2011 | Sprole | 2/69.5 |
| 2012/0110716 | A1 * | 5/2012 | Christensen et al. | 2/69.5 |
| 2012/0125347 | A1 * | 5/2012 | Soileau | 128/873 |
| 2015/0020309 | A1 * | 1/2015 | Pitchforth et al. | 5/413 AM |

FOREIGN PATENT DOCUMENTS

| | | | |
|---|---|---|---|
| CN | 201263561 | | 7/2009 |
| CN | 201263561 | Y | 7/2009 |
| CN | 101816498 | | 9/2010 |
| CN | 202525711 | | 11/2012 |
| GB | 1113026 | A | 5/1968 |
| JP | 2001252160 | | 9/2001 |
| WO | 2008150183 | A1 | 12/2008 |

* cited by examiner

SHELL WITH ARM PORTS

CROSS-REFERENCE TO RELATED APPLICATION

This nonprovisional application claims priority to U.S. Provisional Patent Application Ser. No. 61/828,348, titled Sleeping Bag, filed on May 29, 2013, which is incorporated in its entirety by reference.

FIELD

The field of the disclosure relates generally to sleeping bags. More particularly, this disclosure relates to a sleeping bag allowing a user within the sleeping bag to access the exterior through a pair of zipperless openings.

BACKGROUND

Typically, sleeping bags are used when a conventional bed and bedding are unavailable. For example, sleeping bags are used by backpackers, hikers, campers, mountaineers, and other users as portable beds or coverings. Sleeping bags are often durable sleeping coverings that provide a soft surface, insulation and weather resistance.

Consumers face a difficult task in finding a sleeping bag that is thermally efficient, comfortable, and lightweight. One type of sleeping bag, referred to as a "mummy bag", tends to be shaped with a lateral taper to approximate the contour of the body of a user and thereby minimize the internal volume of the bag. Mummy bags attempt to conserve heat by minimizing air movement within, and from the bag. As a result, mummy bags are often suited for use in outdoor, colder ambient temperatures.

To enter typical mummy bags, a user must unzip the bag, and then get inside the bag. Due to the tight fit, the user may find it difficult to fully zip the bag, and furthermore, the zipped bag may be uncomfortable. For example, one drawback to the mummy bag is that some users feel discomfort due to the tight fit of the bag, which may reduce the user's range of motion. Another drawback of mummy bags is that the user is prevented from having external access without unzipping the bag and thereby compromising the warmth of the bag.

Some mummy bags include diametrically opposed zippered ports located along a side panel of the sleeping bag, between an overlying portion and an underlying portion. Although these bags include ports to allow the user external access, one drawback is that the constraint of the mummy bag makes it difficult for the user to access the zippers to open the ports. Moreover, these ports are located along the side panels at a position adjacent to the upper arms and shoulders of the user and the zippers are orientated generally parallel with the longitudinal length of the bag, making unzipping the ports difficult for users located within a closed bag. As a result, the user may be required to unzip the bag, introducing air flow into the bag and losing heat, to obtain enough access to unzip the ports and to extend the user's arm through the port.

Accordingly, a need exists for a sleeping bag that is comfortable, thermally efficient, and provides the user with external access from within the closed bag while preventing the introduction of air flow and loss of heat.

BRIEF DESCRIPTION

In one aspect, a sleeping bag generally comprises an elongate shell defining a longitudinal axis and an inner volume sized and shaped to receive a user therein. The shell has an overlying portion adapted to overlie the user during use, an underlying portion adapted to underlie the user during use, and a pair of arm ports. Each of the arm ports is selectively moveable from a closed port position to an opened port position for allowing the user external access from within the bag. Each of the ports comprises an inner panel and an outer panel. The inner panel is positioned in overlapping face-to-face engagement with the outer panel in the closed port position such that the inner and outer panels are generally in the same plane as the overlying portion. The outer panel is spaced from the inner panel in the opened port position to define a passage for allowing the user to extend their arm through the respective port.

In another aspect, a sleeping bag generally comprises an elongate shell defining an inner volume sized and shaped to receive a user therein. The shell has an overlying portion adapted to overlie the user during use and an underlying portion adapted to underlie the user during use. The overlying portion includes a longitudinally extending zipper providing user ingress to and egress from the inner volume of the shell. Arm ports are selectively moveable from a closed port position to an opened port position for allowing the user external access from within the bag. Each of the ports comprises an inner panel, an outer panel, and a draft curtain. The draft curtains are positionable to inhibit air from entering the inner volume in the closed port position.

In yet another aspect, a sleeping bag generally comprises an elongate shell defining an inner volume sized and shaped to receive a user therein. The shell has an overlying portion adapted to overlie the user during use and an underlying portion adapted to underlie the user during use. The overlying portion includes a longitudinally extending zipper providing user ingress to and egress from the inner volume of the shell. Arm ports are selectively moveable from a closed port position to an opened port position to allow the user external access from within the bag. Each of the ports comprises an inner panel and an outer panel. The inner panel is positioned in overlapping face-to-face engagement with the outer panel in the closed port position and the outer panel is spaced from the inner panel in the opened port position to define a passage for allowing the user to extend their arm through the respective port. Each of the ports is fastener free.

In still another aspect, an elongate shell defines an inner volume sized and shaped to receive a user therein. The shell has a front portion adapted to cover the front of a user during use and a back portion adapted to cover the back of the user during use. Arm ports are selectively moveable from a closed port position to an opened port position to allow the user external access from within the bag. Each of the ports comprises an inner panel and an outer panel. The inner panel is positioned in overlapping face-to-face engagement with the outer panel in the closed port position and the outer panel is spaced from the inner panel in the opened port position to define a passage for allowing the user to extend their arm through the respective port. An opening in a bottom portion of the shell allows a user's feet to extend through the opening to the exterior of the inner volume.

Various refinements exist of the features noted in the above-mentioned aspects. Further features may also be incorporated in the above-mentioned aspects. These refinements and additional features may exist individually or in any combination. For instance, various features discussed below in relation to any of the illustrated embodiments may be incorporated into any of the above-described aspects, alone or in any combination.

BRIEF DESCRIPTION OF THE DRAWINGS

Corresponding reference characters indicate corresponding parts throughout the several views of the drawings.

DETAILED DESCRIPTION OF THE DRAWINGS

Figure 1:
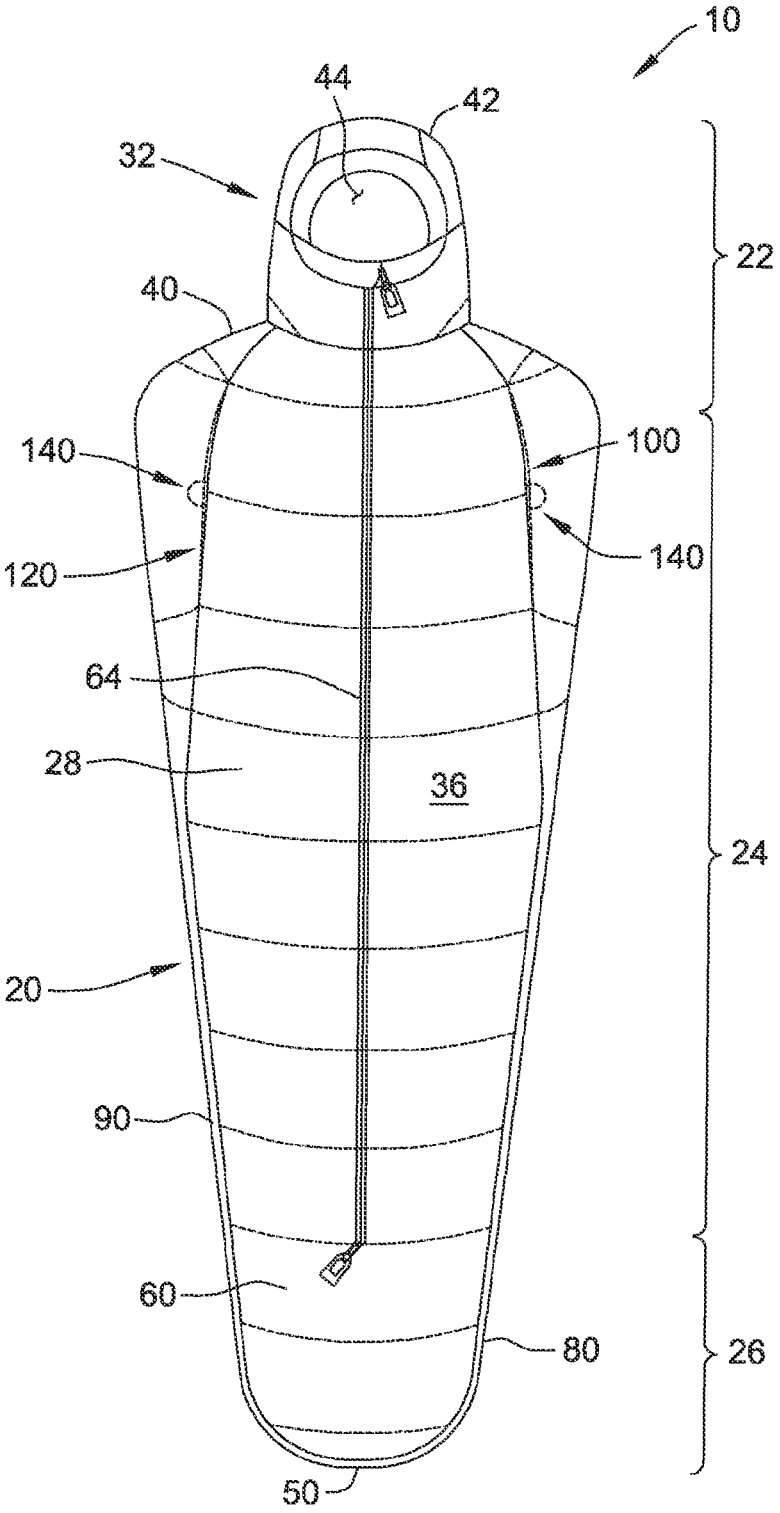
FIG. 1 is a top plan view of one embodiment of a sleeping bag having zipperless ports.
Figure 2:
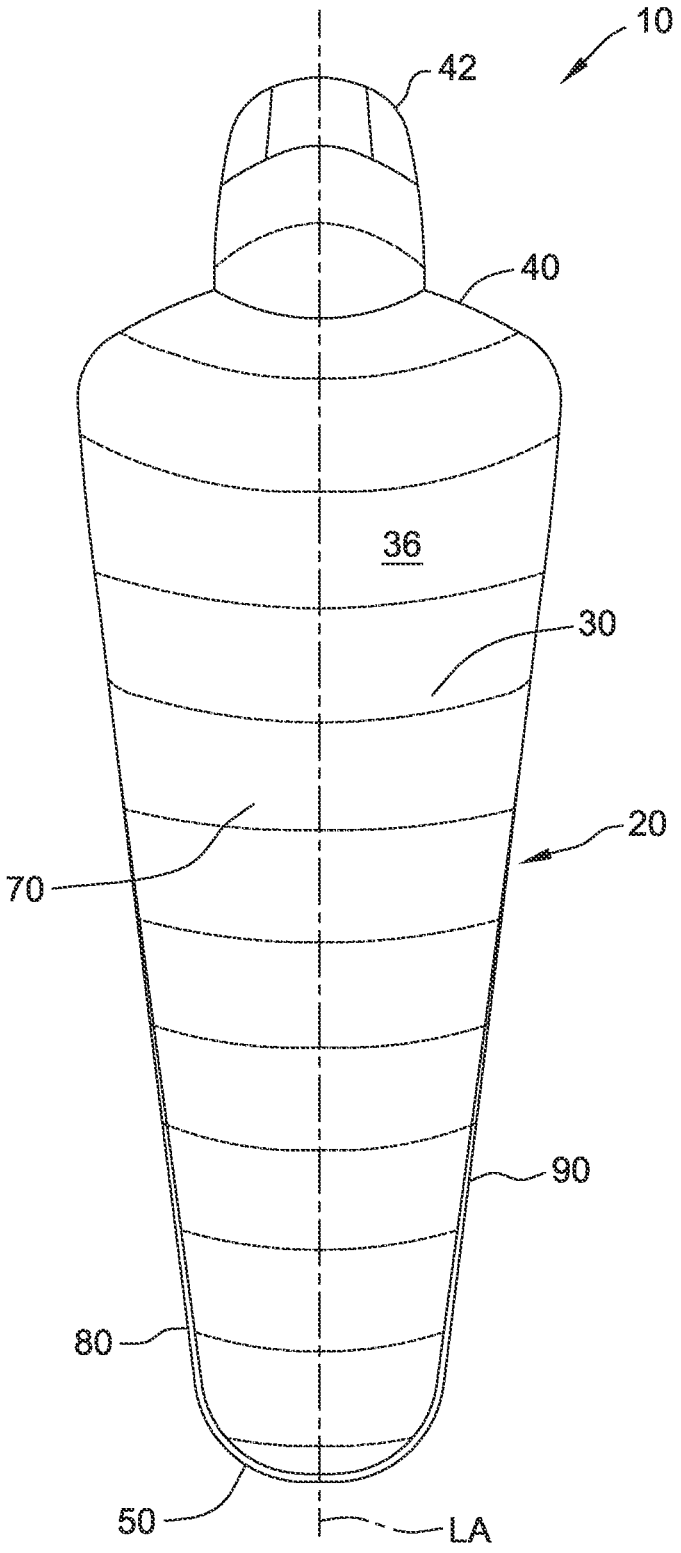
FIG. 2 is a bottom plan view of the sleeping bag of FIG. 1.

Referring now to the drawings and in particular to FIGS. 1-6, one embodiment of a sleeping bag is designated in its entirety by the reference number 10. The sleeping bag 10 includes an elongate shell, indicated generally at 20, that defines a longitudinal axis LA and an inner volume that is sized and shaped to receive a user therein. The shell 20 has a head portion 22, a foot portion 26, and a middle portion 24 extending longitudinally between the head and foot portions (FIG. 1). In addition, the shell 20 has an overlying portion 28 (FIG. 1), which is adapted to overlie the user during use, and an underlying portion 30 (FIG. 2), which is adapted to underlie the user during use. The head portion 22 of the illustrated sleeping bag 10 includes a hood portion, indicated generally at 32. It is understood that the hood portion 32 can be omitted in some embodiments of the sleeping bag 10 without departing from the scope of this disclosure. The sleeping bag 10 illustrated in FIGS. 1-6 is a "regular" size bag adapted to fit users up to 6 feet tall. It is understood that the sleeping bag 10 can have any suitable size (e.g., shorter, longer, wider, narrower) and can be adapted specifically for men, women or youths.

The shell 20 further has a head end panel 40 located in the head portion 22, a foot end panel 50 located in the foot portion 26, a front panel 60 located in the overlying portion 28, a back panel 70 located in the underlying portion 30, and a pair of spaced side panels 80, 90 (i.e., a right (or first) side panel 80 and a left (or second) side panel 90 as viewed in FIG. 1) located in the middle portion 24. The side panels 80, 90 extend longitudinally between the head end panel 40 and the foot end panel 50. The head end panel 40, the foot end panel 50, and the side panels 80, 90 are stitched between the front panel 60 and back panel 70. As a result, the panels 40, 50, 60, 70, 80, and 90 collectively provide vertical expansion of the shell 20 thus adding inner volume to the sleeping bag 10. It is contemplated that in some embodiments, the panels 40, 42, 50, 80, and 90 can be omitted without departing from some aspects of this disclosure.

The hood portion 32 includes a hood panel 42 connected to the head end panel 40. The hood panel 42 is adapted to receive and surround the head of a user during use of the sleeping bag 10. The hood panel 42 in the illustrated embodiment further includes an opening 44 for allowing the user's face, or at least a portion, to be exposed during use of the sleeping bag 10. It is contemplated that the opening 44 can be suitably larger than the face of the user. The hood panel 42 may include a draw cord, a zipper, snaps, hook and loop fasteners, or any other suitable fasteners positioned about the opening 44 to allow the user to constrict the size of the opening.

Figure 10:
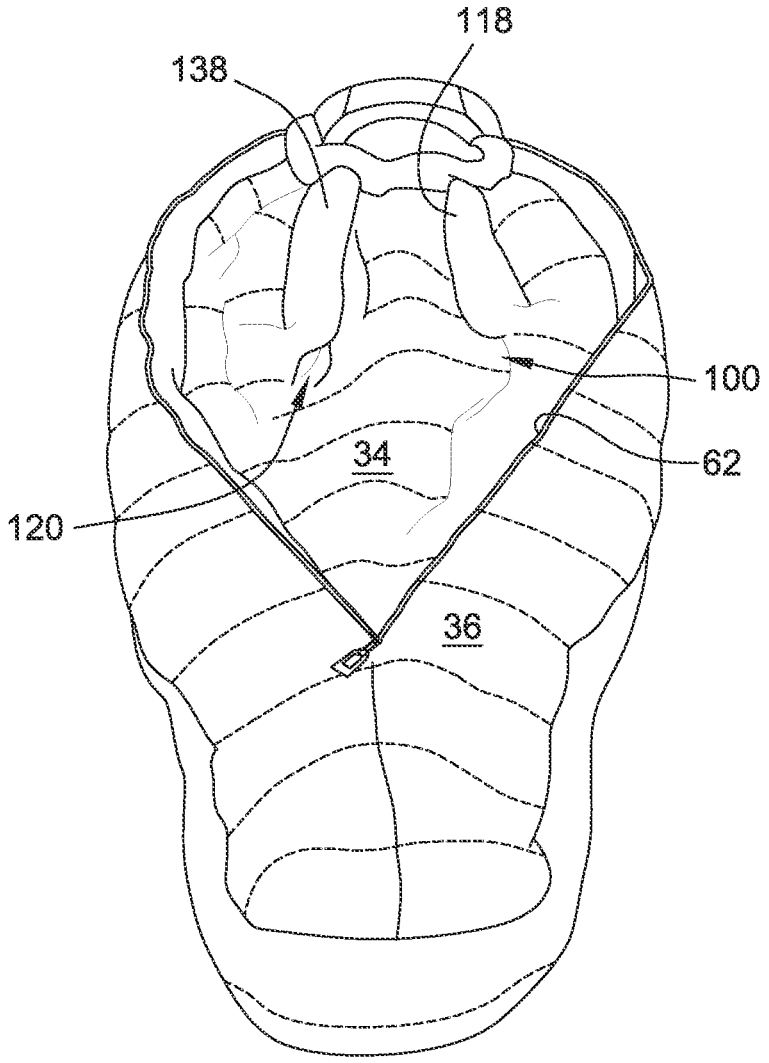
FIG. 10 is an internal view of the sleeping bag showing draft curtains associated with each of the zipperless ports, each of the drat curtains being in a closed position.
Figure 11:
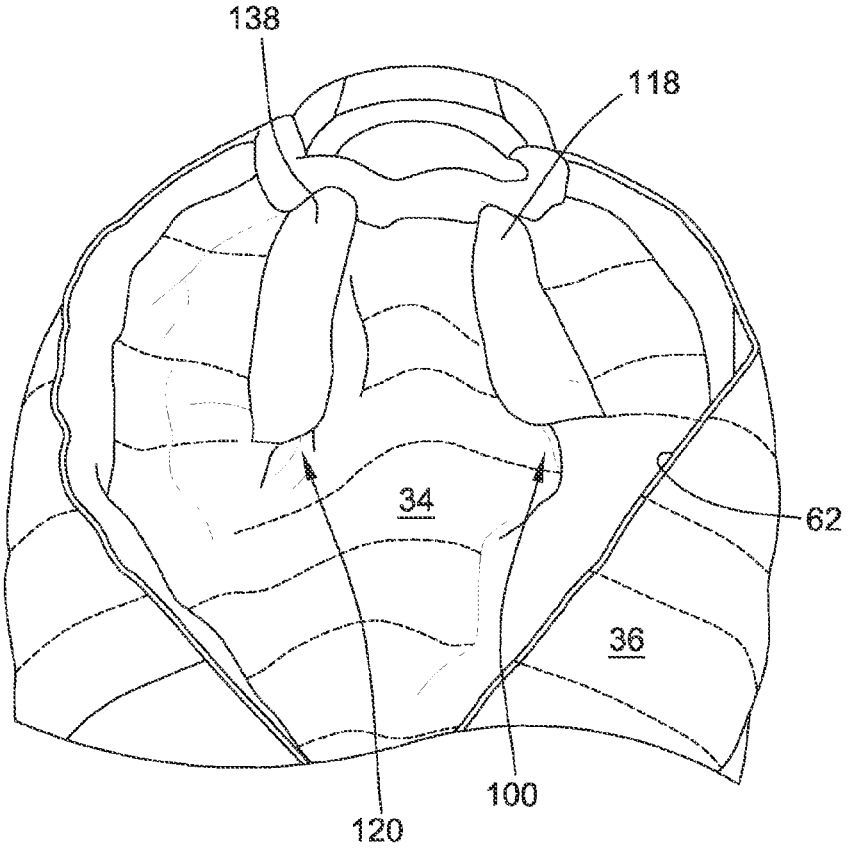
FIG. 11 is an enlarged internal view of the draft curtains of FIG. 10.
Figure 12:
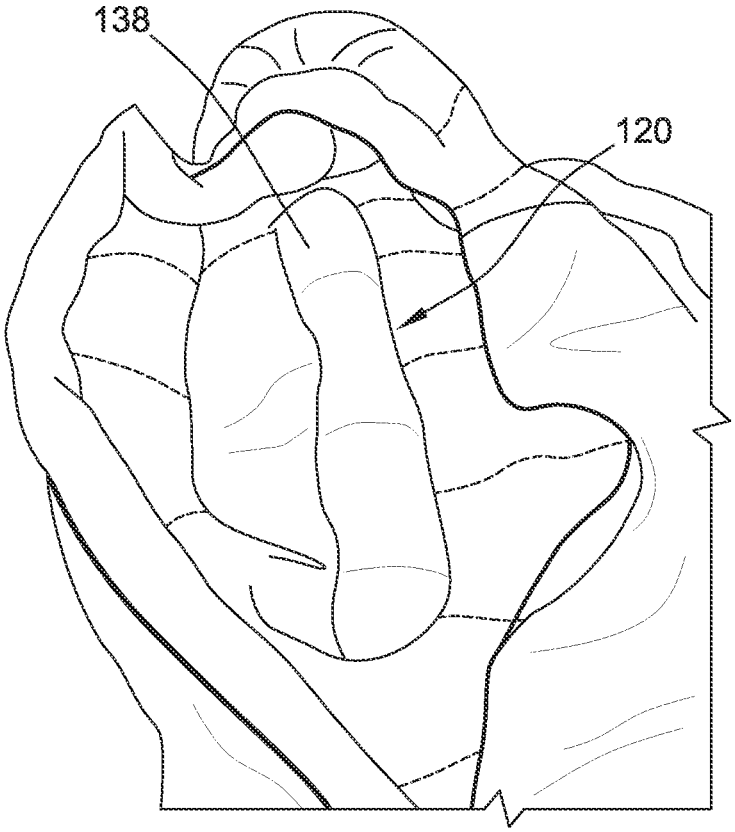
FIG. 12 is an enlarged internal view of the left draft curtain of FIGS. 10 and 11.
Figure 13:
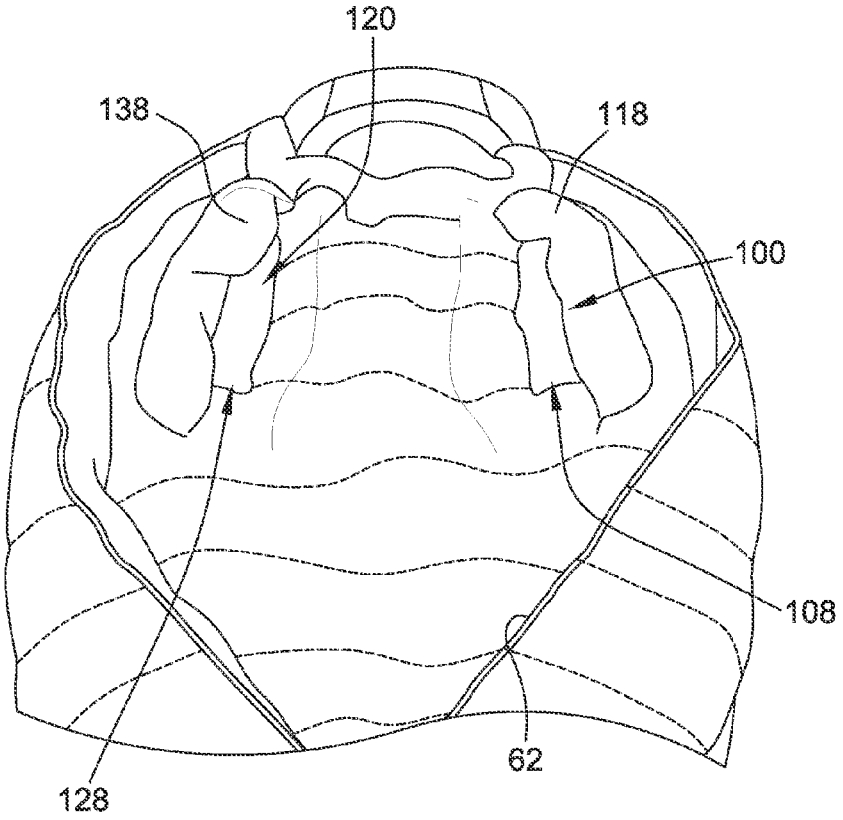
FIG. 13 is an enlarged internal view of the draft curtains similar to FIG. 11 but showing the draft curtains in an open position.

As seen in FIGS. 1 and 10, the front panel 60 includes a longitudinal opening 62 extending from the head portion 22 down through the middle portion 24 to provide user ingress to and egress from the inner volume of the shell. The longitudinal opening 62 can have any suitable length. Thus, the longitudinal opening 62 can have a greater or lesser length than that illustrated herein. The front panel further includes a zipper (or slide fastener) 64 extending along the longitudinal opening 62 to secure the longitudinal opening in a closed position. In the closed position, air movement through the opening 62 and into the inner volume of the shell 20 is inhibited. In another embodiment, the longitudinal opening 62 and the associated zipper 64 may extend along a side of the sleeping bag, between the overlying portion 28 and the underlying portion 30. It is understood that other suitable closures besides the illustrated zipper 64 can be used to close the longitudinal opening 62 including, but not limited to, hook and loop, snaps, magnets, and buttons.

In the embodiment seen in FIGS. 1-6, the shell 20 tapers from the head portion 22 toward the foot portion 26 to generally conform to the contours of the user. As a result, the sleeping bag 10 is broadest in the region corresponding to the shoulders of the user and narrowest or tapered in the region corresponding to the feet of the user. The tapered shell 20 provides the user a generally snug fit. By generally conforming to the contours of the user when the user is substantially occupying the inner zone of sleeping bag 10, air movement within the sleeping bag 10 is minimized thus making the bag thermally efficient. The illustrated sleeping bag 10 can be generally categorized as a mummy type bag. It is understood, however, that in other embodiments the sleeping bag 10 could have less taper (e.g., a rectangular-type bag).

With reference now to FIG. 10, the shell 20 has an inner layer 34, which defines the inner volume of the shell 20, and an outer layer 36, which defines the exterior of the shell. The inner layer 34 is adapted to receive a user occupying the inner volume of the sleeping bag 10. An insulation material (not shown) is disposed between the inner and outer layers 34, 36 to provide warmth and softness to the sleeping bag 10. The insulation material can be attached to the inner layer 34 and/or the outer layer 36 of the shell using stitch-lines. It is understood that the inner and outer layers 34, 36 can be any suitable material (e.g., polyester). It is also understood that the inner layer 34 can be made from a material different that the outer layer 36. It is further understood that the insulation material can be any suitable material (e.g., goose down, CLOUDLOFT insulation, DRIDOWN insulation) and that the amount of insulation material can be selected to achieve the desired warmth and softness.

Figure 4:
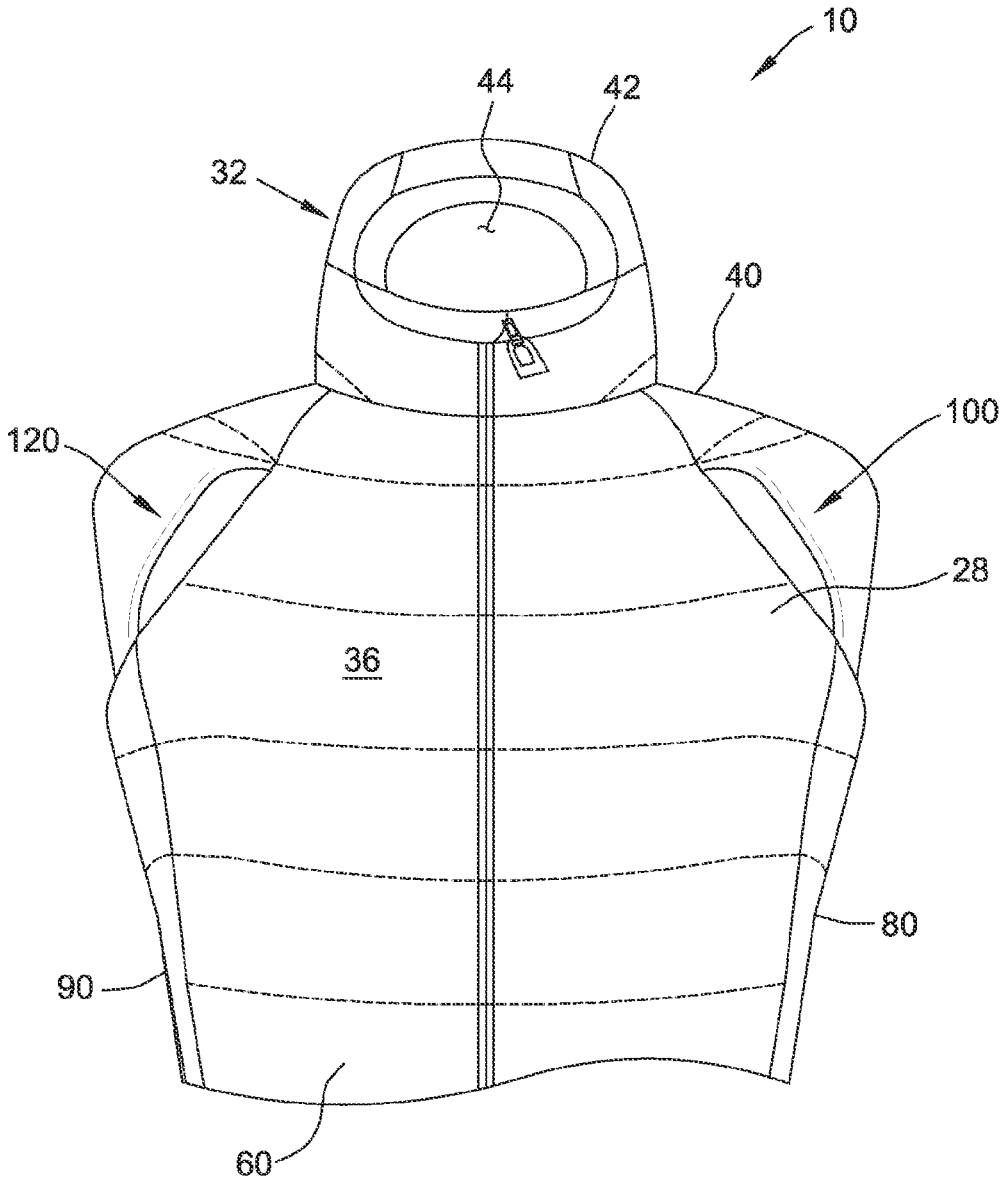
FIG. 4 is an enlarged top perspective view showing a portion of the sleeping bag of FIG. 3.
Figure 5:
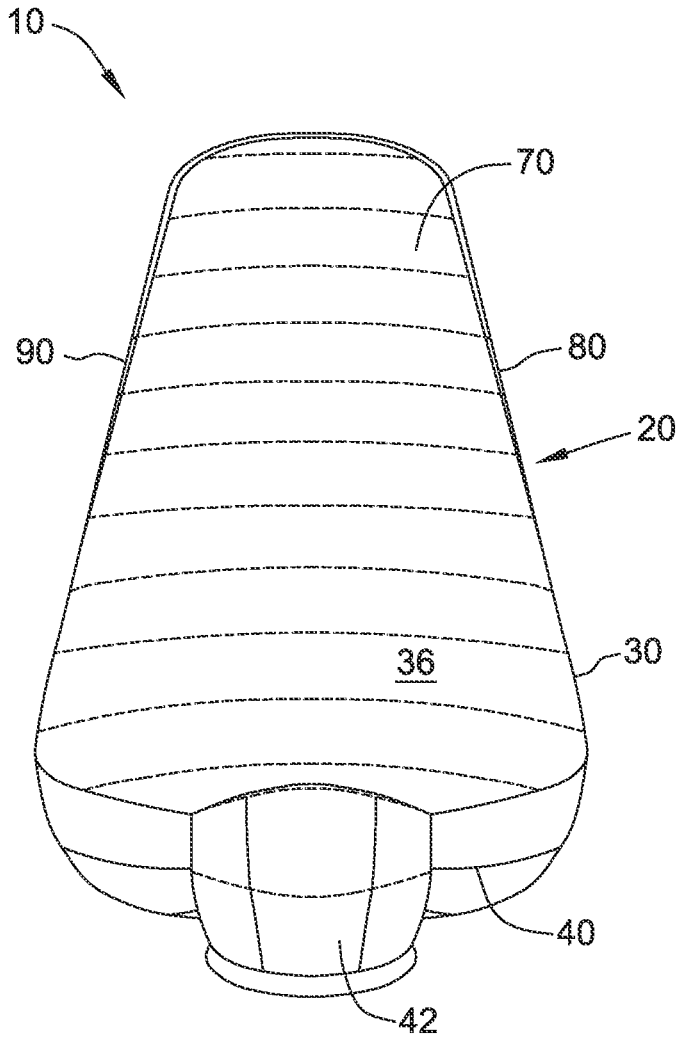
FIG. 5 is a bottom perspective view of the sleeping bag of FIG. 1.
Figure 6:
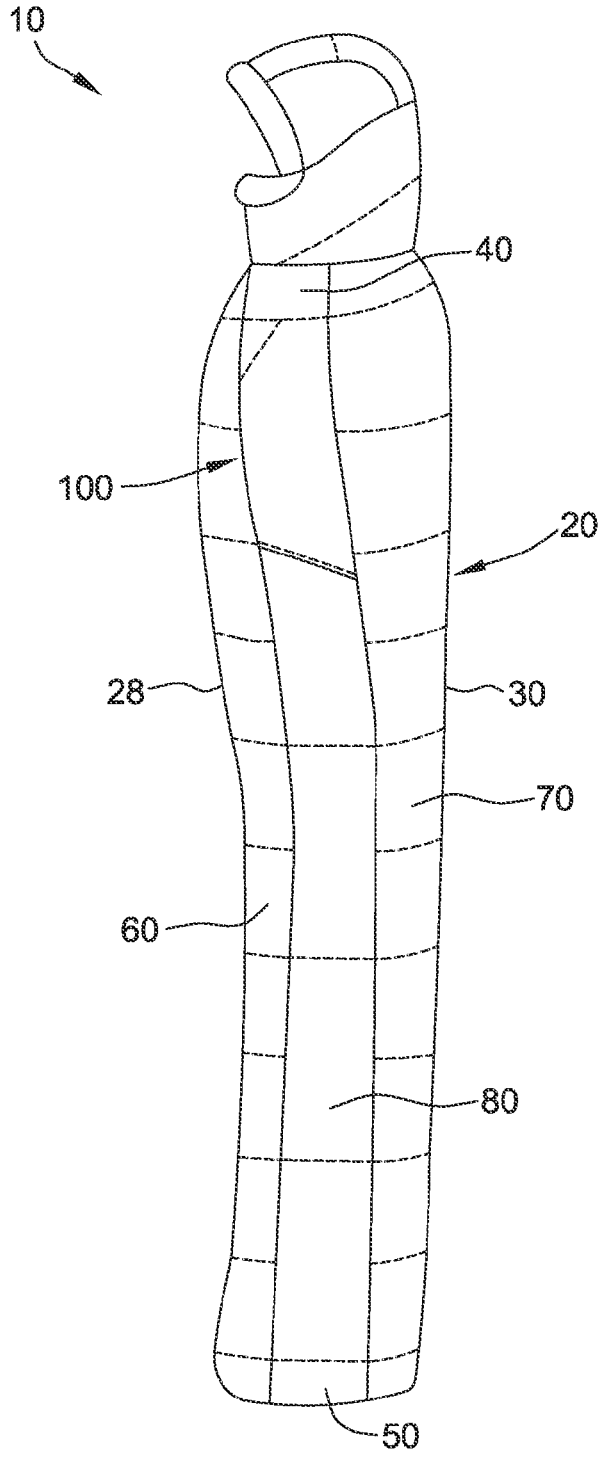
FIG. 6 is a right side elevation of the sleeping bag of FIG. 1.

With reference to FIGS. 1, 7-9 and 13, the illustrated sleeping bag 10 and, more specifically, the overlying portion 28 includes a right side port 100 and a left side port 120 that define respective passages 108, 128 through the shell 20 for allowing the user external access from within the sleeping bag 10. The ports 100, 120 of the illustrated sleeping bag 10 are located on the overlying portion 28 such that the user can selectively extend their arms through the ports 100, 120. Most suitably, as seen in FIG. 4, the ports 100, 120 of the illustrated sleeping bag 10 embodiment are located on the front panel 60 of the overlying portion 28. It is understood, however, that the ports 100, 120 can be positioned in other locations along the sleeping bag 10 without departing from some aspects of this disclosure. An advantage of locating the ports 100, 120 on the front panel 60 is that a user inside the sleeping bag 10 can extend their arms straight out from their body and through the ports. Thus, a user has better access to the exterior of the sleeping bag 10 by extending their arms straight in front of them rather than reaching off to a side, which would be required if the ports 100, 120 were located on the side panels 80, 90.

Figure 8:
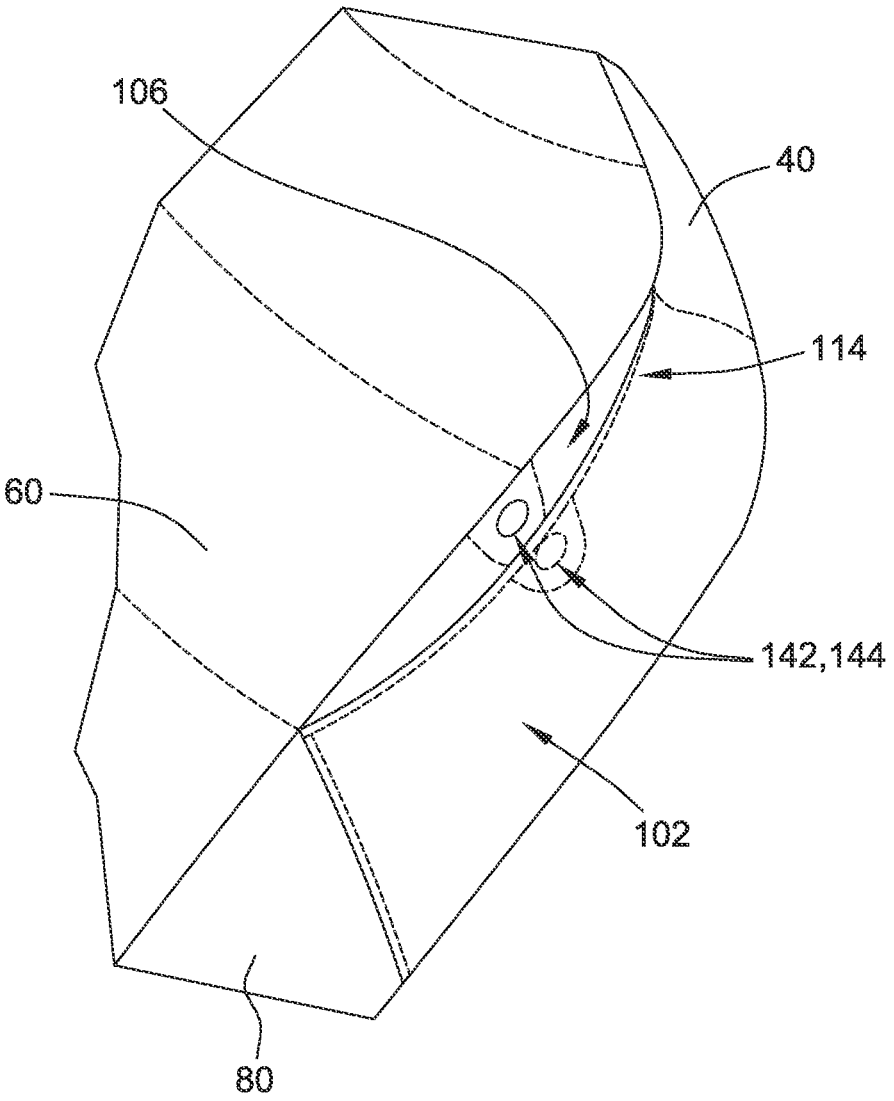
FIG. 8 is a perspective view of the right zipperless port of FIG. 7.

As seen in FIGS. 1, 4 and 8, each of the ports 100, 120 includes an outer panel 102 and an inner panel 106. A closed port position, as illustrated for example in FIG. 4, is defined by the outer panel 102 overlapping in direct face-to-face relationship the inner panel 106. The overlapping relationship of the outer and inner panels 102, 106 inhibits air from entering the interior space of the sleeping bag 10. Moreover, the outer panel 102 and inner panel 106 are configured to inhibit the ports 100, 120 from unintentionally opening during use of the sleeping bag 10.

Figure 9:
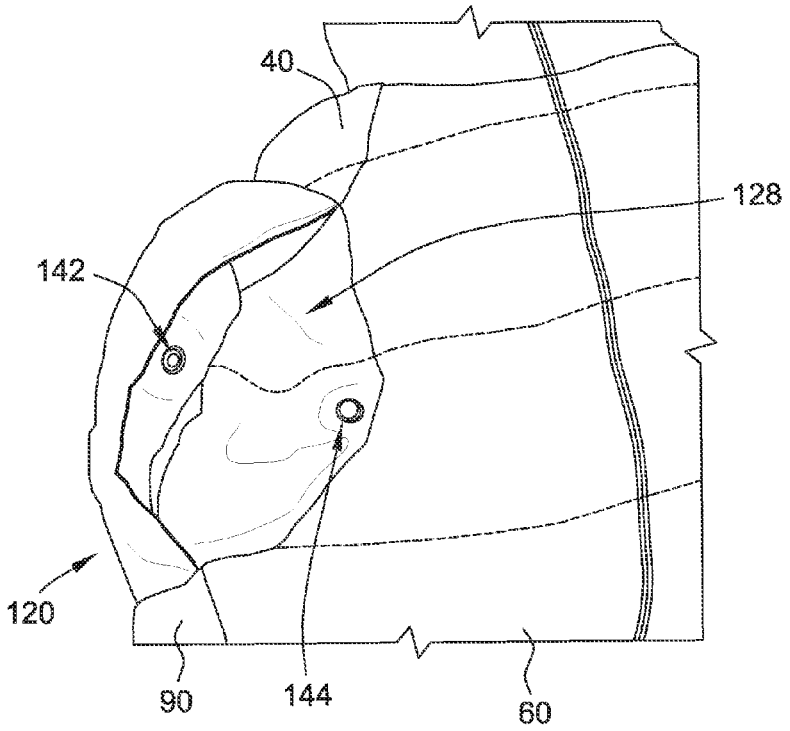
FIG. 9 is an external view of the left zipperless port of the sleeping bag with the zipperless port in an open position.

An opened port position, as illustrated for example in FIG. 9, is defined by the outer panel 102 being at least in part spaced from the inner panel 106. In the opened port position, the user is able to extend their arms through the respective passages 108, 128 of the ports 100, 120 to a position external (i.e., outside) the sleeping bag 10. When the user draws their arm or arms back into the sleeping bags, the outer panel 102 and inner panel 106 are configured to move the ports 100, 120 back to the closed port position without any additional effort by the user. That is, upon an arm being withdrawn from one of the ports 100, 120, the outer panel 102 will automatically return to the closed position overlying the inner panel 106.

Figure 14:
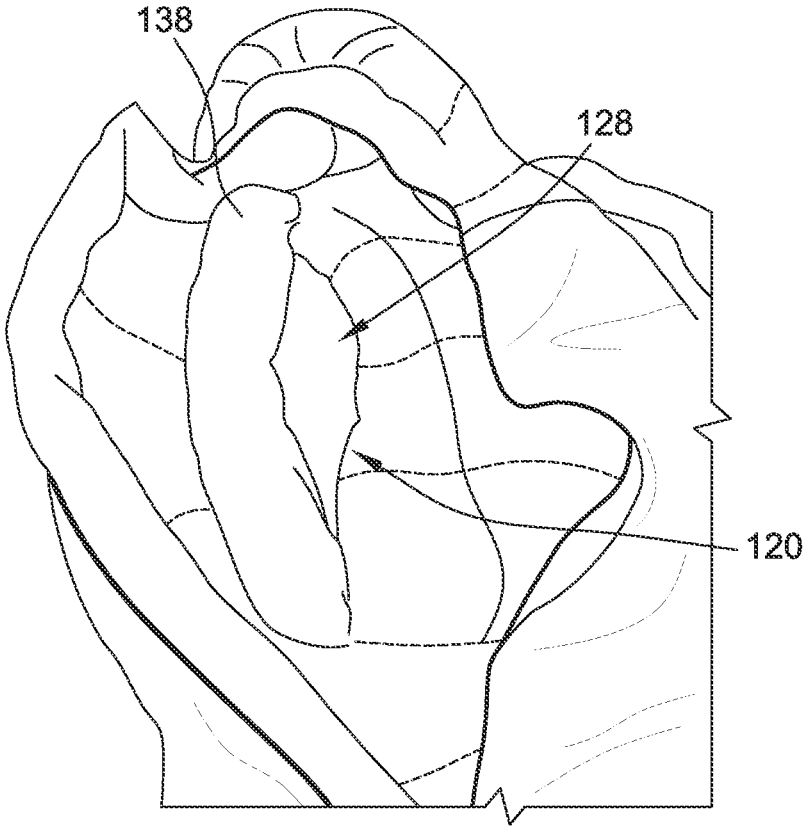
FIG. 14 is an enlarged internal view of the left draft curtain similar to FIG. 12 but showing the draft curtain in an open position.
Figure 15:
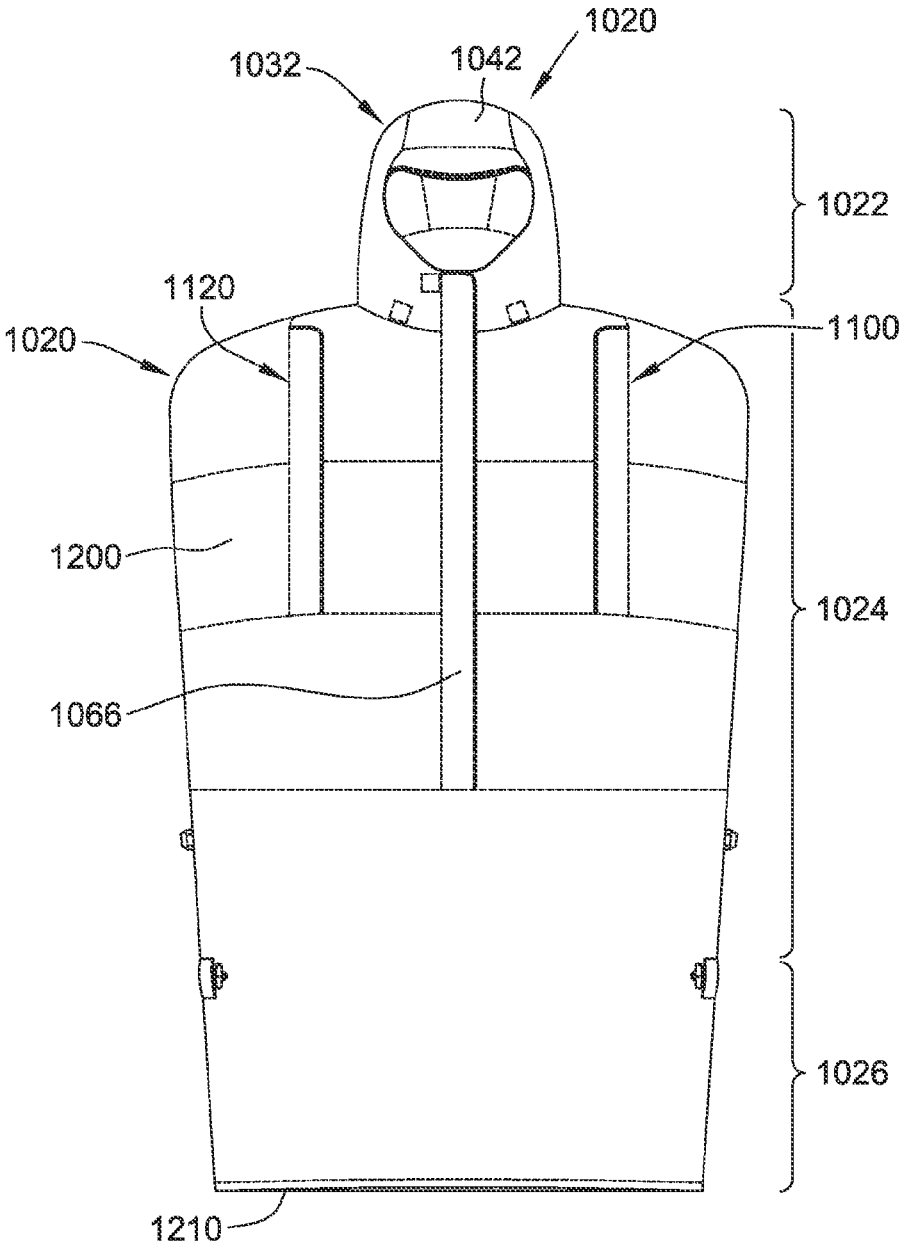
FIG. 15 is a top plan view of an embodiment of a shell having zipperless ports.

In one suitable example, each passage has a maximum exterior opening (FIG. 9) of about 12 inches and a maximum interior length (FIGS. 13 and 14) of about 18 inches along the length of the port 100, 120. It is contemplated, however, that the maximum exterior and interior lengths of the opening can differ from those disclosed herein. It is also contemplated that the maximum exterior and interior lengths can be equal and that the maximum interior length can be greater than the maximum exterior length.

As illustrated in FIG. 8, each of the outer panel 102 and the inner panel 106 are attached (e.g., stitched) to the respective side panel 80, 90 at both of their longitudinal ends. In the closed port position (FIG. 4), each of the outer and inner panels 102, 106 lie generally in the same plane as the front panel 60. As a result, in the closed port position, the outer and inner panels 102, 106 define part of the overlying portion 28. In the opened port position (FIG. 9), each of the outer and inner panels 102, 106 lie generally perpendicular to the front panel 60. Stated another way, the outer and inner panels 102, 106 are disposed generally parallel to the side panels 80, 90 of the sleeping bag 10 in the opened port position.

Figure 3:
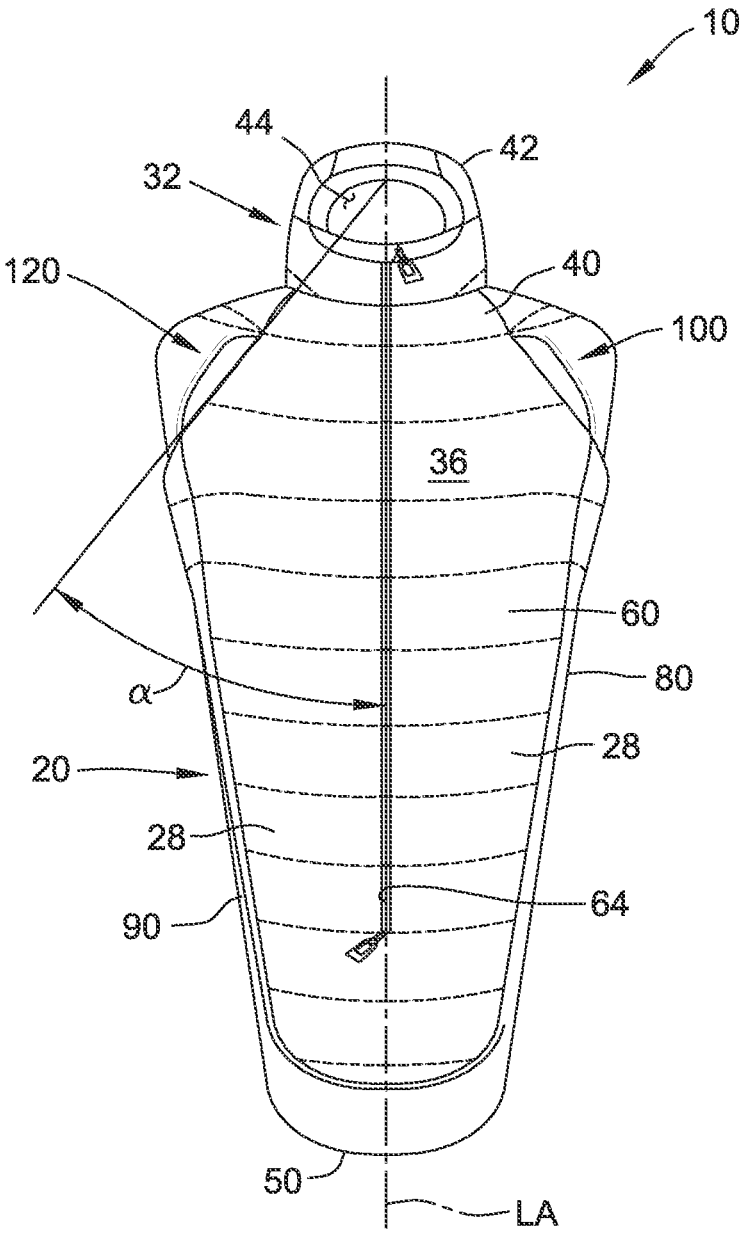
FIG. 3 is a top perspective view of the sleeping bag of FIG. 1.

As shown in FIG. 3, each of the ports 100, 120 in the closed port position form an angle $\alpha$ with the longitudinal axis LA. In one suitable embodiment, the angle $\alpha$ is between about 10 degrees and about 50 degrees. In the illustrated embodiment, for example, the angle $\alpha$ is approximately 30 degrees.

Suitably, the outer and inner panels 102, 106 can be made from the same material as the shell 20 (i.e., an inner layer, an outer layer, and an insulation material between the inner and outer layers) but it is understood that the outer and inner panels can be made from any suitable material or materials. For example, it is contemplated that at least one of the outer and inner panels 102, 106 can be devoid of any insulation material. It is also contemplated the outer and inner panels 102, 106 can have less insulation material than other portions of the shell 30.

In the illustrated embodiment, the outer panel 102 has a width that is substantially equal to a width of the inner panel 106. It is contemplated, however, that the outer and inner panels 102, 106 can have different widths. In another suitable embodiment, the width of the outer panel 102 can be greater than the width of the inner panel 106. It is also contemplated that the width of the outer and/or inner panel 102, 106 can vary along its length, e.g., to conform to the contours of the sleeping bag 10.

Figure 7:
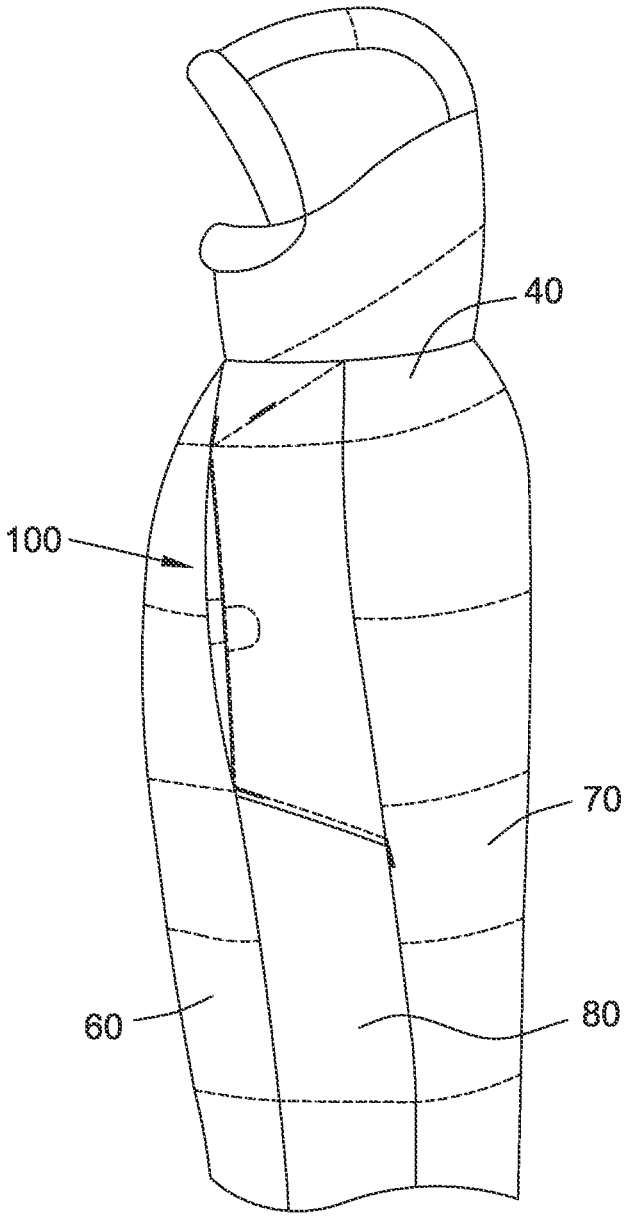
FIG. 7 is an enlarged right side elevation showing a portion of the sleeping bag of FIG. 6 and illustrating the right zipperless port.

Due to the flexibility of the shell 20, the shape of the passages 108, 128 will change as a result of movement by a user within the inner volume of the shell 20. As shown in FIGS. 7 and 8, in one suitable embodiment the outer panel 102 includes a stiffener 114 adapted to maintain at least the top portion of the outer panel 102 in general alignment with the inner panel 106. The stiffener 114 is provided to inhibit displacement of the outer panel 102 with respect to the inner panel 106. As a result, the stiffener 114 provides rigidity to at least the top portion of the outer panel 102 to assist in the sealing of the port 100, 120. The stiffener 114 also inhibits the sagging of the outer panel 102. It is contemplated that the stiffener 114 can extend through more or less of the outer panel 102. It is also contemplated that the inner panel 106 can include a stiffener in addition to or instead of the outer panel 102 having the stiffener 114.

With reference to FIGS. 10-14, the shell 20 includes a pair of draft curtains 118, 138 connected with and extending within the inner volume of the sleeping bag 10 to seal the port 100, 120 from within the bag and thereby inhibit the introduction of outside air into the inner volume through the ports. As seen in FIGS. 10-14, each of the draft curtain 118, 138 is an elongated, insulated flap that extends outward from adjacent each of the inner panels 106. The draft curtains 118, 138 are relatively heavily stitched to provide a substantially rigid structure that has the ability to pivot as a solid piece to ease manipulation of the draft curtain by the user. Each of the draft curtains 118, 138 is stitched along its proximate longitudinal edge to the inner layer 34 adjacent one of the ports 100, 120 and, more specifically, to a portion of inner layer defining the overlying portion 28. In the illustrated embodiment, the draft curtains 118, 138 are also stitched along at least a portion of their ends to the inner layer 34 and, more specifically, to a portion of the inner layer defining the underlying portion 30. Thus, the illustrated draft curtains 118, 138 are attached to both the overlying portion 28 and the underlying portion 30 of the inner layer 34 to thereby facilitate closing the respective port 100, 120. The arm or body of a user located within the sleeping bag 10 pushes against the draft curtain 118, 138 to aid in the sealing of the port 100, 120 and maintaining the port in a closed position. The distal edge of each of the draft curtains 118, 138 is free from attachment.

As stated above, each of the ports 100, 120 are configured to seal without the use of any fasteners. That is, the ports 100, 120 are suitably fastener-less ports. However, each of the ports 100, 120 may include a fastener 140 without departing from some aspects of this disclosure. In one suitable embodiment, the fastener 140 has a first part 142 disposed on the outer panel 102 and a second part 144 disposed on the inner panel 106 to retain the port 100, 120 in a closed position. As illustrated in FIG. 8, the first part 142 is in alignment with the second part 144 when the respective port 100, 120 is in the closed position. In the illustrated embodiment, the first part 142 and the second part 144 are located along the top of the ports 100, 120 and are configured to connect with each other to inhibit the outer panel 102 from being displaced from the inner panel 106. The first part 142 and second part 144 could be magnets or any other suitable fastener. Ideally the fasteners 140 are magnets configured to automatically seal the ports 100, 120 when closed. The magnets can be concealed by sewing into the inner panel 106 and outer panel 102 or the magnets could be disposed on the surface of the inner panel 106 and outer panel 102.

During use, a user located within a zipped sleeping bag 10 inserts the user's arm under the draft curtain 118, 138 to separate the draft curtain from the back panel 70 of the sleeping bag. The user then extends the user's arm through the respective port 100, 120 and passes it through the passage 108, 128. With the user's arms fully extended through the ports 100, 120, the draft curtains 118, 138 rest across the user's shoulders.

An advantage of the above embodiments is that when the user is in the sleeping bag, the user's body naturally pushes out on the draft curtain to seal the port. Another advantage is that the above embodiment allows the user to access an exterior environment without the need to unzip a zipper, making external access easier and more convenient. In addition, the above disclosed ports provide a tortuous path to inhibit the introduction of air into the interior of the sleeping bag causing loss of heat.

FIGS. 15-21 show an embodiment of an elongate shell having zipperless arm ports indicated in its entirety by the reference number 1020. This embodiment utilizes the zipperless arm ports to allow a user to wear the shell 1020 as a coat, cloak, or other covering. Similar to sleeping bag 10, the shell 1020 includes a pair of zipperless arm ports 1100, 1120. The shell 1020 defines a longitudinal axis LA2 and has an inner volume that is sized and shaped to receive a user therein. The shell 1020 has a head portion 1022, a foot portion 1026, and a middle portion 1024 extending longitudinally between the head and foot portions. In addition, the shell 1020 has a front portion 1200, which is adapted to drape in front of the user during use, and a back portion 1202, which is adapted to drape behind the user during use.

The shell 1020 is configured with less breaks and edges than traditional coats, cloaks, or other coverings. The scarcity of breaks enables a user wearing the shell 1020 to blend in better with the surrounding environment. Additionally, the draping configuration of the shell 1020 disguises or otherwise hides some of the user's movement underneath the shell. Therefore, a user may, for example, shift their position, fidget with an object, or mover their arms and legs within the shell 1020 without moving the shell. Thus, the shell 1020 minimizes the potential that movement by the user, such as a hunter, will disturb sensitive wildlife.

The shell 1020 can be any suitable color. In one suitable embodiment, for example, the shell 1020 can be brown, green, camouflage, and other natural colors to increase functionality for hunters and other users who wish to blend in with their surroundings. For users who wish to stand out against the environment, the shell 1020 can be a bright color, such as orange and yellow.

Figure 19:
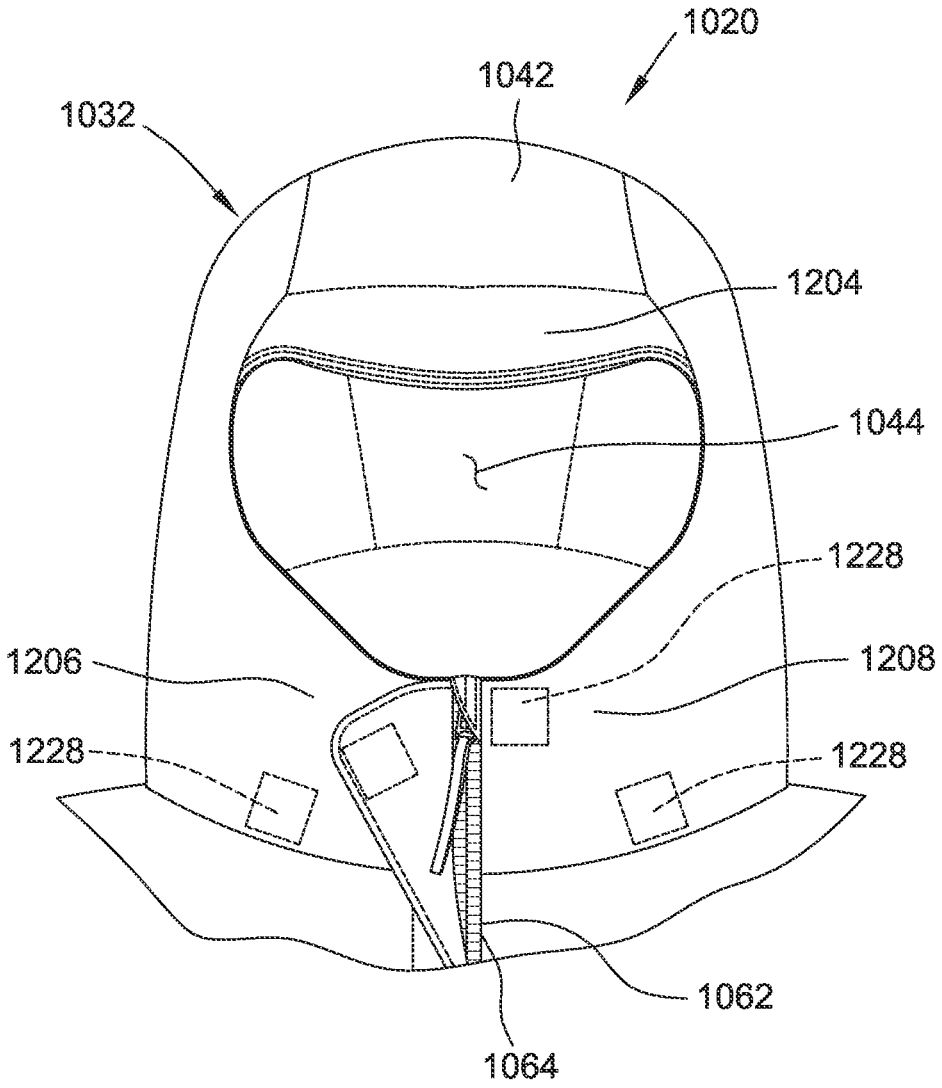
FIG. 19 is an enlarged view of a portion of the shell of FIG. 15.

As shown in FIG. 19, the head portion 1022 of the illustrated shell 1020 includes a hood portion, indicated generally at 1032. The hood portion 1032 includes a hood panel 1042, a left collar 1206 and a right collar 1208, as viewed in FIG. 19. The hood panel 1042 and collar 1206, 1208 in the illustrated embodiment cooperatively define an opening 1044 for allowing the user's face, or at least a portion thereof, to be exposed during use of the shell 1020. It is contemplated that the opening 1044 can be suitably larger or smaller than the face of the user. The hood panel 1042 may include a draw cord, a zipper, snaps, hook and loop fasteners, or any other suitable fasteners positioned about the opening 1044 to allow the user to alter the size of the opening. In the illustrated embodiment, a visor 1204 is attached to hood panel 1042 directly above the opening 1044. It is understood, however, that the visor 1204 can be omitted.

Both the left collar 1206 and the right collar 1208 are selectively positionable by the user. More specifically, the left collar 1206 and right collar 1208 can be opened away from the user's face or closed to at least partially cover the user's face. The left collar 1206 and the right collar 1208 can include fasteners to retain them in varying positions. In the illustrated embodiment, for example, the left collar 1206 and the right collar 1208 include magnetic fasteners 1226 for retaining the respective collar in the desired position. It is understood, however, that any sort of fastener can be used. The sizes, shapes, and configurations of the hood panel 1042, the opening 1044, the visor 1204, the left collar 1206, and the right collar 1208 allow users to maintain peripheral vision and hearing while their head is selectively covered.

Figure 20:
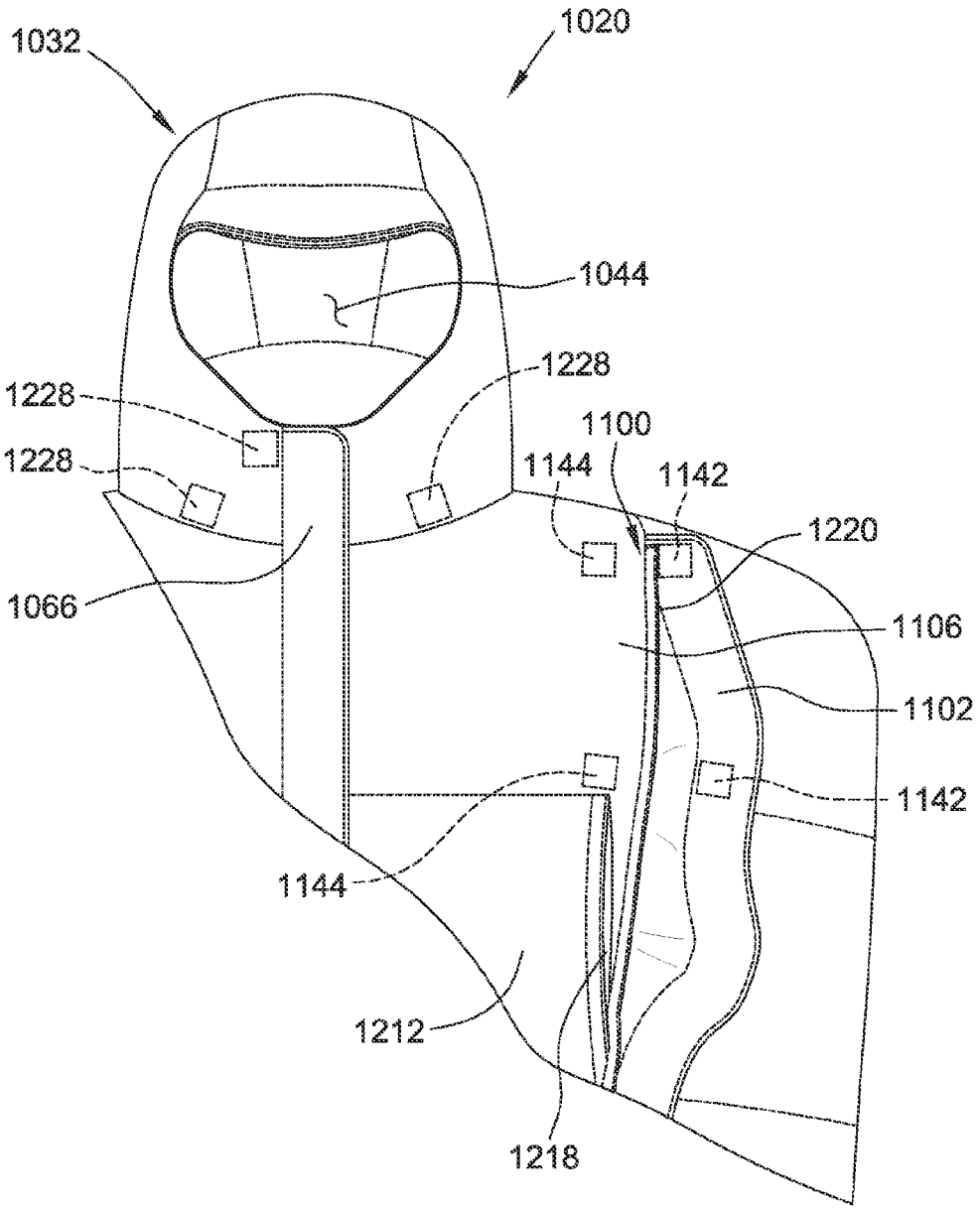
FIG. 20 is an enlarged view of a portion of the shell of FIG. 15 with the right zipperless port in an open position.

Similar to ports 100, 120 of sleeping bag 10, the ports 1100, 1120 include an outer panel 1102 and an inner panel 1106. The left port 1100 is shown in FIG. 20. A closed port position is defined by the outer panel 1102 overlapping in direct face-to-face relationship with the inner panel 1106. In the illustrated embodiment, the ports 1100, 1120 include a drip edge 1220, which is a small ridge attached to the shell 1020 adjacent to ports 1100, 1120. The drip edge 1220 inhibits precipitation, wind, and other elements from entering the inner volume of the elongate shell 1020 through the ports 1100, 1120. In use, the respective drip edge 1220 directs precipitation along its length and, thus, away from the ports 1100, 1120.

Also similar to ports 100, 120 of sleeping bag 10, each of the ports 1100, 1120 are configured to seal without the use of any fasteners. However, each of the ports 1100, 1120 may include a fastener 1140 to retain the port 1100, 1120 in a closed position without departing from some aspects of this disclosure. In one suitable embodiment, the fastener 1140 has first parts 1142 disposed on the outer panel 1102 and second parts 1144 disposed on the inner panel 1106. In the illustrated embodiment, the first parts 1142 and the second parts 1144 are spaced along the respective panels 1102, 1106. The first parts 1142 are in alignment with the second parts 1144 when the respective port 1100, 1120 is in the closed position. The first parts 1142 and second parts 1144 could be magnets or any other suitable fastener. Ideally the fasteners 1140 are magnets configured to automatically seal the ports 1100, 1120 when closed. The magnets can be concealed by sewing into the inner panel 1106 and outer panel 1102 or the magnets could be disposed on the surface of the inner panel 1106 and outer panel 1102.

Adjacent to each of the ports 1100, 1120 is a pouch 1212 located on the exterior of the front portion 1200 of the shell 1020, shown in FIG. 20. In the illustrated embodiment, the pouches 1212 are generally rectangular in shape with a free edge 1218 directly adjacent the respective port 1100, 1120. It is understood, however, that the pouches 1212 can be any shape. The free edge 1218 of each of the pouches 1212 can include a fastener to selectively close the pouch. The pouches 1212 can be used for storage and/or for placing a user's hands when the user's arms are extended through the ports 1100, 1120.

The front portion 1200 of the shell 1020 includes a longitudinal opening 1062 and a zipper (or slide fastener) 1064 extending along the longitudinal opening to secure the longitudinal opening in a closed position. In the closed position, air movement through the opening 1062 and into the inner volume of the shell 1020 is inhibited. For improved sealing of the longitudinal opening 1062, the shell 1020 includes a flap 1066 which covers the longitudinal opening and zipper 1064 when in a closed position. In the illustrated embodiment, the longitudinal opening 1062 only extends through a portion of front portion 1200, but it is understood that in other embodiments the longitudinal opening 1062 could extend through the entirety of front portion 1200.

Figure 16:
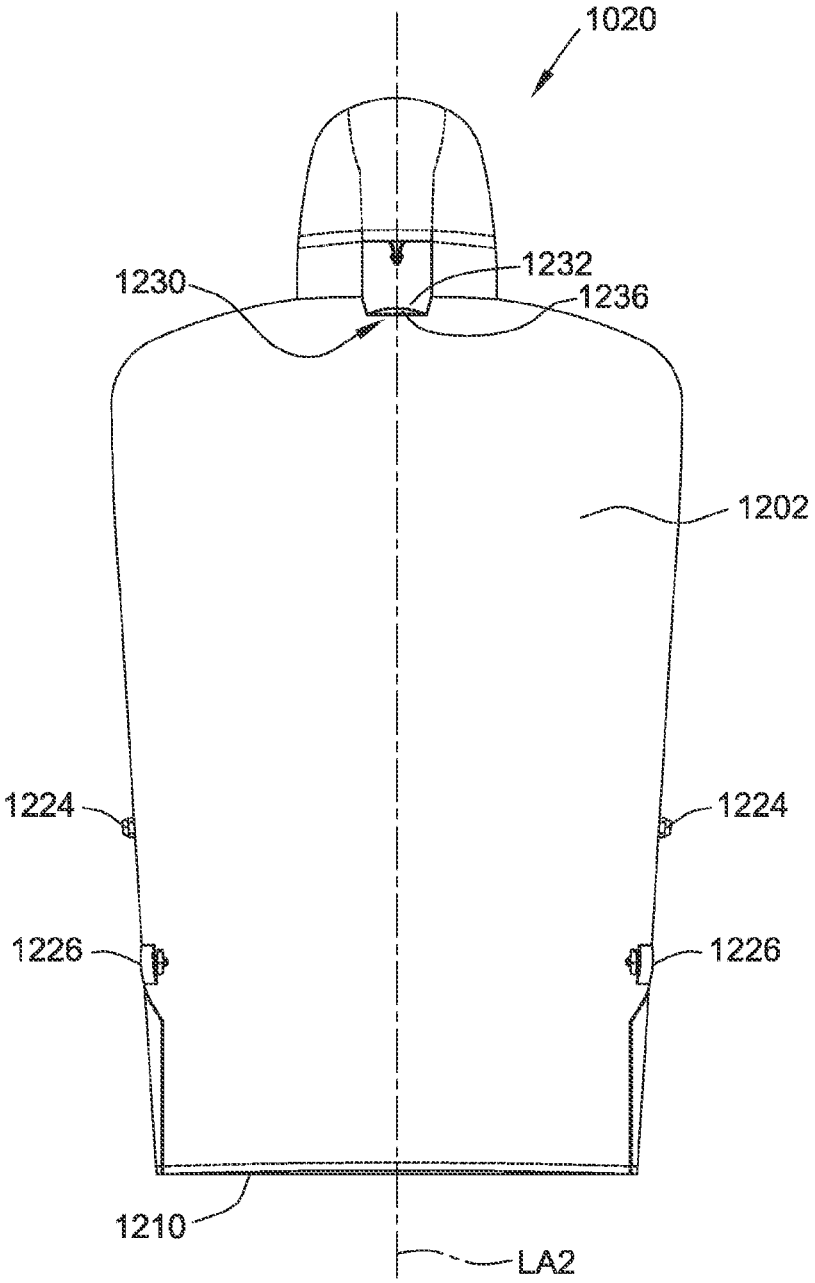
FIG. 16 is a bottom plan view of the shell of FIG. 15.
Figure 17:
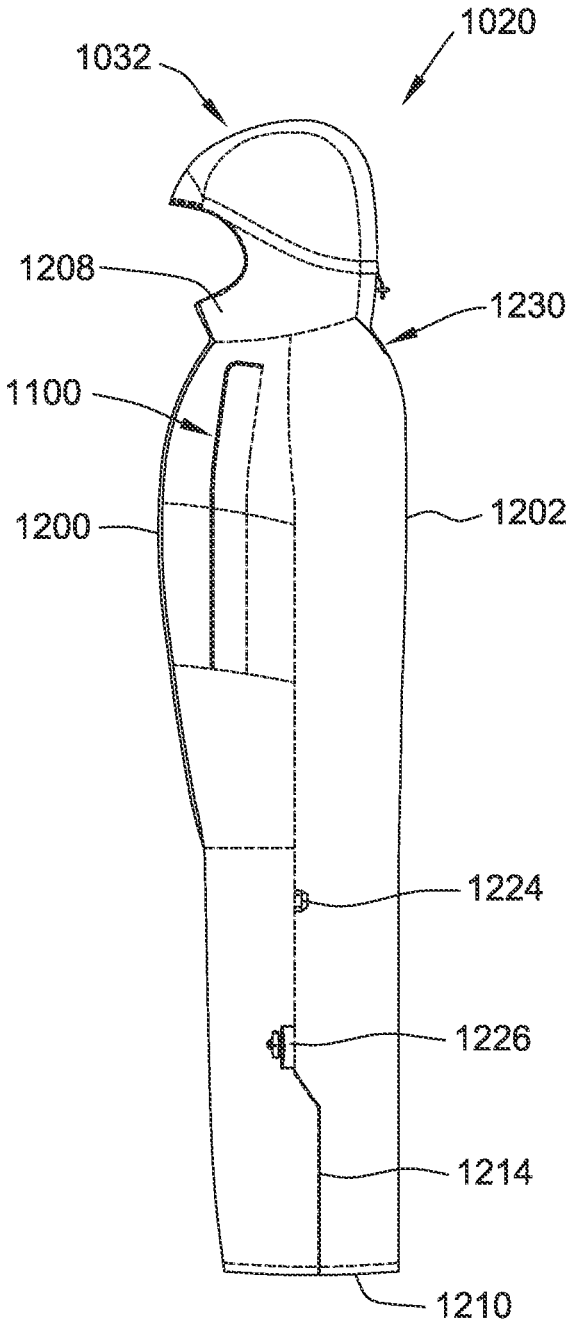
FIG. 17 is a right side elevation of the shell of FIG. 15.
Figure 18:
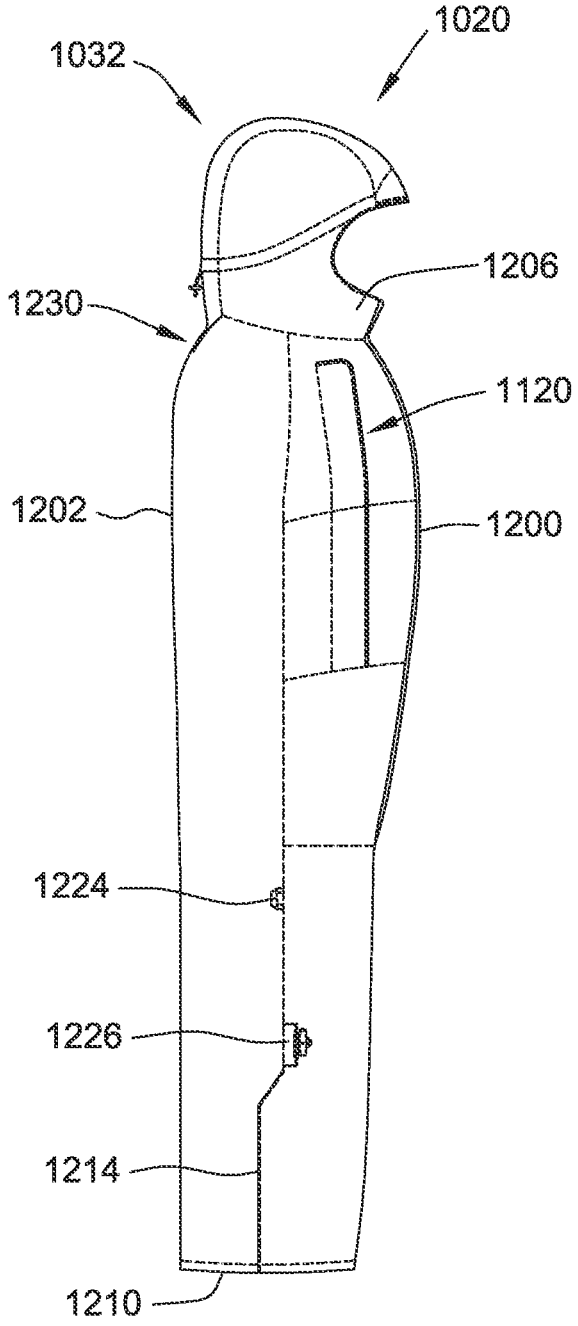
FIG. 18 is a left side elevation of the shell of FIG. 15.

As illustrated in FIG. 16, a slot 1230 is disposed on the back portion 1202 of the shell 1020 and is defined by an outer panel 1232 and an inner panel 1236. A closed slot position, as seen in FIG. 16, is defined by the outer panel 1232 overlapping in direct face-to-face relationship with the inner panel 1236. In the illustrated embodiment, the slot 1230 is configured to seal in the closed slot position without the use of any fasteners. However, the slot 1230 may include one or more fasteners to retain the slot in a closed position without departing from some aspects of this disclosure.

Figure 23:
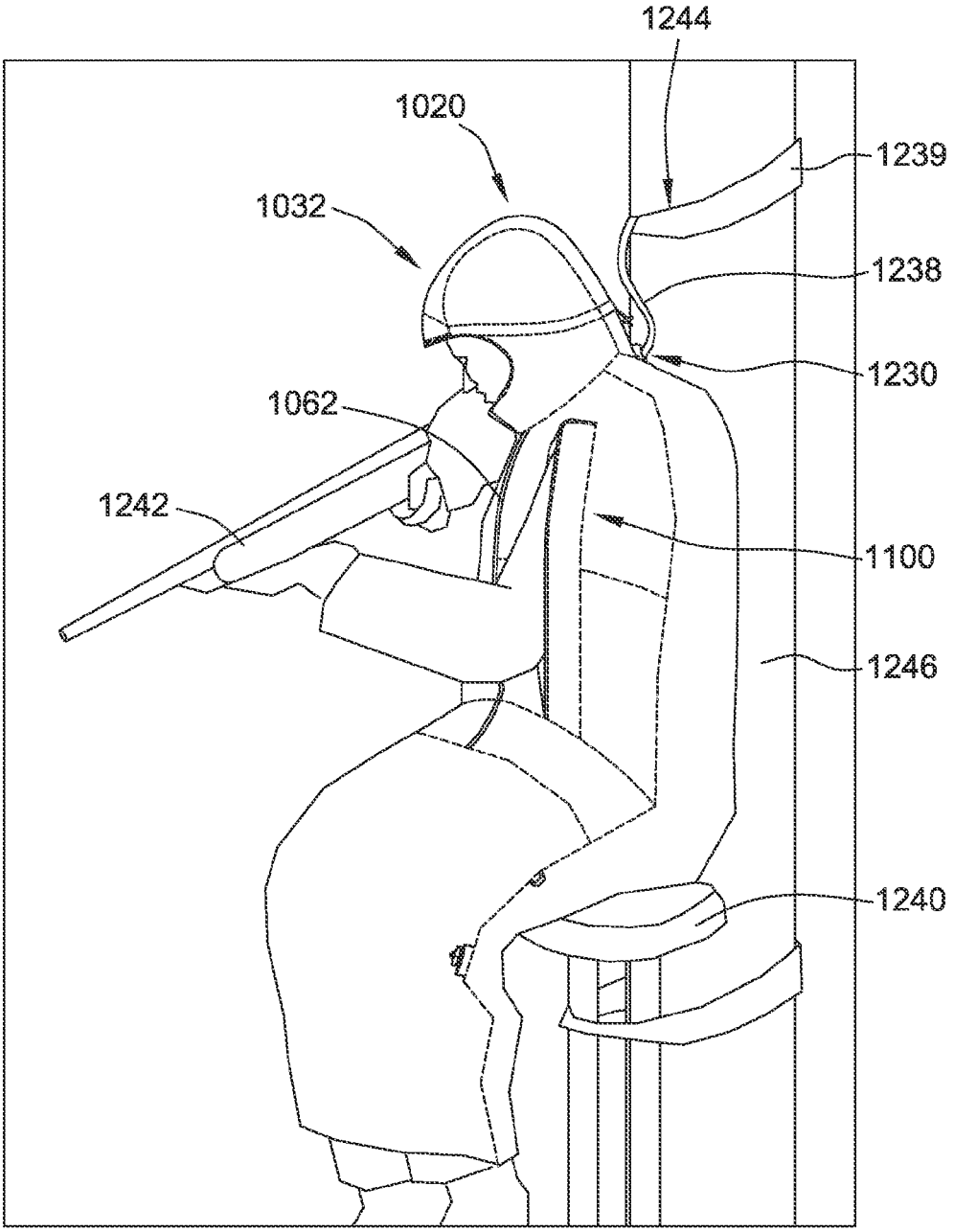
FIG. 23 is a perspective view of a hunter sitting in a tree stand and secured to the tree while wearing the shell of FIG. 15.

An opened slot position is defined by the outer panel 1232 being at least in part spaced from the inner panel 1236, as seen in FIG. 23. In the opened slot position, the user is able to extend an object through the slot 1230 to a position external (i.e., outside) the shell 1020. Thus, objects, such as a harness strap 1238, can be attached to a user while wearing the shell 1020 and extend through the slot 1230 to the exterior of the shell.

FIG. 23, for example, shows a user sitting in a tree stand 1240 wearing the shell 1020. The ports 1100, 1120 (only the left port 1100 can be seen in FIG. 23) are in an open position to allow the user access to the exterior of shell 1020. The user has his/her arms extended through ports 1100, 1120 in the front of the shell 1020 and holding a firearm 1242. The hood portion 1032 is positioned to cover the user's head and the longitudinal opening 1062 is in a closed position. A harness, indicated generally at 1244, comprising the harness strap 1238 and a suitable anchor 1239 provides fall protection for the user while in the tree stand 1240. The harness strap 1238 is attached to the user underneath the shell 1020 and extends through the slot 1230 to the exterior of the shell where it is attached to the anchor 1239. The anchor 1239 is wrapped around a tree 1246 to secure the harness 1244 to the tree.

Figure 21:
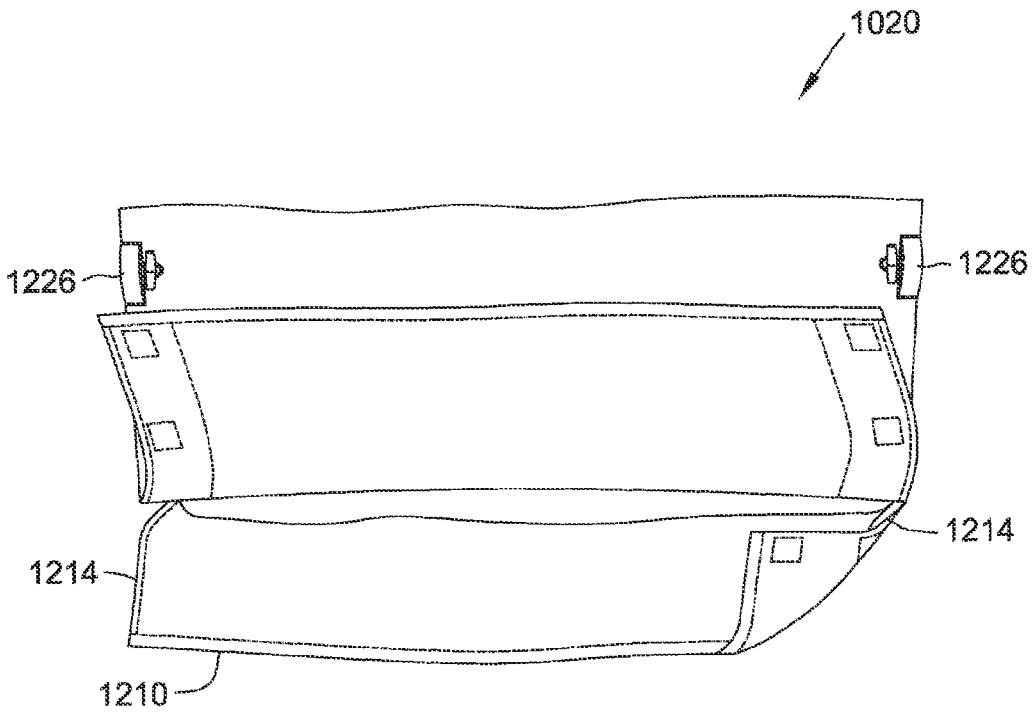
FIG. 21 is an enlarged view of a portion of the shell of FIG. 15 illustrating the opening in the foot portion of the shell.

As shown in FIG. 21, the foot portion 1026 of the shell 1020 includes a foot opening 1210 for a user to extend their feet through during use. This allows the user to ambulate while wearing the shell 1020. The foot opening 1210 may also be used for user ingress to and egress from the inner volume of the elongate shell 1020. In the illustrated embodiment, slits 1214 allow the user to enlarge the foot opening 1210.

Figure 22:
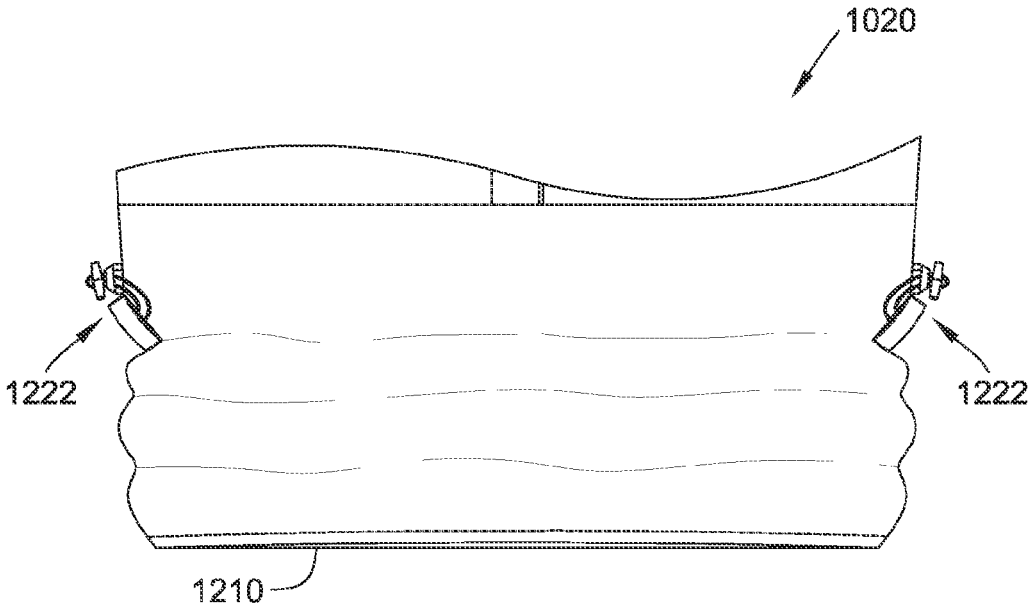
FIG. 22 is an enlarged view of a portion of the shell of FIG. 15 illustrating the foot portion of the shell in a bunched configuration.

The foot portion 1026 also includes bottom fasteners 1222, which allow the foot portion to be fastened in a bunched configuration, as shown in FIG. 22. It is understood that any sort of fastener can be used. In the illustrated embodiment, the bottom fasteners 1222 comprise a loop 1224 disposed on each side of the shell 1020 in the middle portion 1024 and a peg 1226 disposed on each side of the shell 1020 in the foot portion 1026. To fasten the foot portion 1026 in a bunched configuration, the pegs 1226 may be placed through the loops 1224. In the bunched configuration, the foot portion 1026 is selectively gathered approximately at a user's knees, which allows for increased movement by the user. It is understood that other suitable fasteners besides the illustrated loop and peg can be used to gather the foot portion in the bunched configuration including, but not limited to, snaps, magnets, and buttons.

In alternate embodiments, not shown, varying configurations of the bottom fasteners 1222 enable the user to selectively gather the foot portion 1026 in different bunched configurations. For example, the shell 1020 could include multiple sets of loops disposed on the sides of the shell at different heights to allow the user to selectively gather up different amounts of the foot portion 1026. The bottom fasteners 1222 may also be configured to allow the user to selectively gather only the front portion 1200, only the back portion 1202 or both the front and back portions in the bunched configuration. The different bunched configurations enable a user to perform different actions, such as climbing a ladder or kneeling, while wearing the shell 1020.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description and shown in the accompanying drawings shall be interpreted as illustrative and not in a limiting sense.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

What is claimed is:

1. A sleeping bag comprising:

an elongate shell defining a longitudinal axis and an inner volume sized and shaped to receive a user therein, the shell having:

an overlying portion adapted to overlie the user during use;

an underlying portion adapted to underlie the user during use;

a head end panel, a foot end panel, and a pair of spaced side panels extending longitudinally between the head end panel and the foot end panel; and a pair of arm ports, each of the arm ports being selectively moveable from a closed port position to an opened port position for allowing the user external access from within the bag, each of the ports comprising an inner panel and an outer panel wherein at least one of the inner panel and the outer panel is attached to a respective side panel of the pair of spaced side panels, the inner panel being positioned in overlapping face-to-face engagement with the outer panel in the closed port position such that the inner and outer panels are generally in the same plane as the overlying portion, the outer panel being spaced from the inner panel in the opened port position to define a passage for allowing the user to extend their arm through the respective port.

2. The sleeping bag of claim 1, wherein the inner and outer panels are generally perpendicular to the overlying portion in the opened port position.

3. A sleeping bag of claim 1, wherein one of the inner panel and the outer panel includes a stiffener.

4. The sleeping bag of claim 1, further comprising a fastener for holding the inner and outer panels in the closed port position.

5. The sleeping bag of claim 4, wherein the fastener comprises a first part disposed on the outer panel and a second part disposed on the inner panel and adapted to engage the first part.

6. The sleeping bag of claim 1, wherein the head end panel, the foot end panel, and the pair of spaced side panels extend between the overlying portion and the underlying portion.

7. The sleeping bag of claim 6, wherein each of the ports is disposed in the overlying portion and spaced from the side panels.

8. The sleeping bag of claim 1, wherein each of the ports in the closed port position forms an angle with the longitudinal axis.

9. The sleeping bag of claim 8, wherein the angle formed by the ports and the longitudinal axis in the closed port position is between about 10 degrees and about 50 degrees.

10. The sleeping bag of claim 1, wherein, in the opened port position, the inner and outer panels are generally parallel to a side portion of the shell.

11. The sleeping bag of claim 1, further comprising a draft curtain attached to the overlying portion and to the underlying portion.

12. The sleeping bag of claim 1, further comprising a draft curtain that extends outward from the inner panel and toward the overlying portion.

13. A sleeping bag comprising:

an elongate shell defining an inner volume sized and shaped to receive a user therein, the shell having:

an underlying portion adapted to underlie the user during use; and an overlying portion adapted to overlie the user during use, the overlying portion including a longitudinally extending zipper providing user ingress to and egress from the inner volume of the shell, a pair of arm ports being selectively moveable from a closed port position to an opened port position for allowing the user external access from within the bag, each of the ports comprising an inner panel, an outer panel that is separate from and overlapping face-to-face with the inner panel, and a draft curtain attached to the overlying portion and to the underlying portion, the draft curtain being positionable to inhibit air from entering the inner volume in the closed port position.

14. The sleeping bag of claim 13, wherein each of the inner panels are positioned in overlapping face-to-face engagement with the respective outer panel in the closed port position such that the inner and outer panels are generally in the same plane as the overlying portion, the outer panel being spaced from the respective inner panel in the opened port position to define a passage for allowing the user to extend their arm through the respective port.

15. The sleeping bag of claim 14, wherein the inner panel has a width that is substantially equal to a width of the outer panel.

16. The sleeping bag of claim 14, wherein one of the inner panel and the outer panel includes a stiffener.

17. The sleeping bag of claim 14, wherein the draft curtains are positioned within the inner volume.

18. The sleeping bag of claim 17, wherein the draft curtains are attached to respective inner panels.

19. A sleeping bag comprising:

an elongate shell comprising a head end panel, a foot end panel, and a pair of spaced side panels extending longitudinally between the head end panel and the foot end panel, the elongate shell defining an inner volume sized and shaped to receive a user therein, the shell having:

an underlying portion adapted to underlie the user during use and an overlying portion adapted to overlie the user during use, the overlying portion including a longitudinally extending zipper providing user ingress to and egress from the inner volume of the shell, a pair of arm ports being selectively moveable from a closed port position to an opened port position for allowing the user external access from within the bag, each of the ports comprising an inner panel and an outer panel wherein at least one of the inner panel and the outer panel has a longitudinal end attached to a respective side panel of the pair of spaced side panels, the inner panel being positioned in overlapping face-to-face engagement with the outer panel in the closed port position, the outer panel being spaced from the inner panel in the opened port position to define a passage for allowing the user to extend their arm through the respective port, each of the ports being fastener free.

20. The sleeping bag of claim 19, further comprising a draft curtain adjacent each of the ports and selectively positionable to inhibit air from entering the inner volume in the closed port position.

21. The sleeping bag of claim 20, wherein each of the draft curtains are disposed in the inner volume.

22. The sleeping bag of claim 19, wherein the inner and outer panels are generally in the same plane as the overlying portion in the closed port position.

23. The sleeping bag of claim 22, wherein the inner and outer panels are generally perpendicular to the overlying portion in the opened port position.

24. A sleeping bag comprising:

an elongate shell comprising a head end panel, a foot end panel, and a pair of spaced side panels extending longitudinally between the head end panel and the foot end panel, the elongate shell defining a longitudinal axis and an inner volume sized and shaped to receive a user therein, the shell having:

an overlying portion adapted to overlie the user during use;

an underlying portion adapted to underlie the user during use; and a pair of arm ports disposed in the overlying portion, each of the arm ports being selectively moveable from a closed port position to an opened port position for allowing the user external access from within the bag, each of the ports comprising an inner panel and an outer panel, wherein at least one of the inner panel and the outer panel has a longitudinal end attached to a respective side panel of the pair of spaced side panels and at least one of the inner panel and the outer panel extends co-axially outward from the respective side panel, the inner panel being positioned in overlapping face-to-face engagement with the outer panel in the closed port position such that the inner and outer panels are generally in the same plane as the overlying portion, the outer panel being spaced from the inner panel in the opened port position to define a passage for allowing the user to extend their arm through the respective port.

25. The sleeping bag of claim 24 wherein the inner panel and the outer panel extends co-axially outward from the respective side panel and toward the head end panel.

26. The sleeping bag of claim 25, wherein the outer panel includes a curved surface between the side panel and the head end panel.

27. A sleeping bag comprising:

an elongate shell defining a longitudinal axis and an inner volume sized and shaped to receive a user therein, the shell having:

an overlying portion adapted to overlie the user during use;

an underlying portion adapted to underlie the user during use;

a front panel, a back panel, a head end panel, and a foot end panel wherein the head end panel and the foot end panel are attached to the front panel and the back panel; and a pair of arm ports, each of the arm ports being selectively moveable from a closed port position to an opened port position for allowing the user external access from within the bag, each of the ports comprising an inner panel and an outer panel wherein at least one of the inner panel and the outer panel is attached to the head end panel at an intersection of the front panel and head end panel, the inner panel being positioned in overlapping face-to-face engagement with the outer panel in the closed port position such that the inner and outer panels are generally in the same plane as the overlying portion, the outer panel being spaced from the inner panel in the opened port position to define a passage for allowing the user to extend their arm through the respective port.

* * * * *